US011703052B2

(12) United States Patent
Cho et al.

(10) Patent No.: US 11,703,052 B2
(45) Date of Patent: Jul. 18, 2023

(54) HIGH PRESSURE SCROLL COMPRESSOR

(71) Applicant: SAMSUNG ELECTRONICS CO., LTD., Suwon-si (KR)

(72) Inventors: Yang Hee Cho, Suwon-si (KR); Moo Seong Bae, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/311,443

(22) PCT Filed: Oct. 28, 2019

(86) PCT No.: PCT/KR2019/014301
§ 371 (c)(1),
(2) Date: Jun. 7, 2021

(87) PCT Pub. No.: WO2020/116781
PCT Pub. Date: Jun. 11, 2020

(65) Prior Publication Data

US 2022/0025884 A1 Jan. 27, 2022

(30) Foreign Application Priority Data

Dec. 6, 2018 (KR) ..... 10-2018-0155897

(51) Int. Cl.
*F04C 18/02* (2006.01)
*F04C 28/26* (2006.01)
(Continued)

(52) U.S. Cl.
CPC ..... *F04C 18/0215* (2013.01); *F04C 18/0261* (2013.01); *F04C 23/008* (2013.01);
(Continued)

(58) Field of Classification Search
CPC ..... F04C 18/0246; F04C 18/0253
See application file for complete search history.

(56) References Cited

U.S. PATENT DOCUMENTS 7,824,160 B2 11/2010 Nakamura et al.
2004/0126260 A1* 7/2004 Witham ..... F04C 28/265 418/55.5
(Continued)

FOREIGN PATENT DOCUMENTS

JP 2008138644 * 6/2008 ..... F04C 18/02
JP 2010-31729 A 2/2010
(Continued)

OTHER PUBLICATIONS

JP 2008138644 English Language Machine Translation (Year: 2008).*
(Continued)

*Primary Examiner* — Devon C Kramer
*Assistant Examiner* — Wesley G Harris
(74) *Attorney, Agent, or Firm* — Staas & Halsey LLP

(57) ABSTRACT

Disclosed herein is a high-pressure scroll compressor, in response to a discharged refrigerant flowing into a back pressure chamber, capable of directly discharging the refrigerant to a space inside a main body, and capable of maintaining an intermediate pressure of the back pressure chamber to be less than a discharge pressure of the refrigerant by separately providing a discharge flow path in the back pressure chamber.

The high-pressure scroll compressor comprises a main body, a fixed scroll fixed inside the main body, an orbiting scroll engaged with the fixed scroll to perform a relative orbiting motion, and forming a compression chamber with the fixed scroll, a main frame located under the orbiting scroll and including a back pressure chamber filled with an intermediate-pressure refrigerant, a back pressure hole provided in the orbiting scroll and provided to allow the compression chamber to communicate with the back pressure chamber, a bypass portion configured to selectively bypass the refrigerant of the compression chamber to a space inside the main
(Continued)

body, and a back pressure chamber discharge portion configured to selectively discharge the refrigerant of the back pressure chamber to the space inside the main body.

8 Claims, 14 Drawing Sheets

(51) Int. Cl.
*F04C 29/12* (2006.01)
*F04C 23/00* (2006.01)
*F04C 27/00* (2006.01)

(52) U.S. Cl.
CPC ..... *F04C 27/005* (2013.01); *F04C 28/26* (2013.01); *F04C 29/12* (2013.01); *F04C 29/124* (2013.01); *F04C 29/126* (2013.01); *F04C 2240/20* (2013.01); *F04C 2240/30* (2013.01)

(56) References Cited

U.S. PATENT DOCUMENTS

| | | | | |
|---|---|---|---|---|
| 2006/0006598 | A1* | 1/2006 | Kimura | F04C 18/0215 277/302 |
| 2010/0212352 | A1* | 8/2010 | Kim | F04C 29/042 62/513 |
| 2013/0078131 | A1* | 3/2013 | Ahn | F04C 18/0215 418/55.6 |

FOREIGN PATENT DOCUMENTS

| | | | | | |
|---|---|---|---|---|---|
| KR | 10-2000-0007665 | A | | 2/2000 | |
| KR | 10-2005-0028215 | A | | 3/2005 | |
| KR | 10-2005-0028216 | A | | 3/2005 | |
| KR | 10-2006-0020665 | A | | 3/2006 | |
| KR | 10-2006-0128746 | | | 12/2006 | |
| KR | 10-2008-0052275 | | | 6/2008 | |
| KR | 10-0852825 | B1 | | 8/2008 | |
| KR | 10-2012-0105365 | A | | 9/2012 | |
| KR | 10-2013-0094655 | A | | 8/2013 | |
| KR | 10-2014-0002939 | A | | 1/2014 | |
| KR | 10-2014-0114740 | A | | 9/2014 | |
| KR | 10-2018-0093693 | | | 8/2018 | |
| KR | 10-2018-0094407 | A | | 8/2018 | |
| WO | WO 2004/111456 | | * | 12/2004 | F04C 18/02 |
| WO | WO 2012/005007 | | * | 1/2012 | F04C 18/02 |

OTHER PUBLICATIONS

WO 2012/005007 English Language Machine Translation (Year: 2012).*

WO 2004/111456 English Language Machine Translation (Year: 2004).*

International Search Report dated Mar. 4, 2020, in corresponding International Patent Application No. PCT/KR2019/014301.

Office Action dated Nov. 17, 2022, in Korean Application No. 10-2018-0155897.

* cited by examiner

HIGH PRESSURE SCROLL COMPRESSOR

CROSS-REFERENCE TO RELATED APPLICATIONS

This application is a U.S. National Stage Application which claims the benefit under 35 U.S.C. § 371 of International Patent Application No. PCT/KR2019/014301 filed on Oct. 28, 2019, which claims foreign priority benefit under 35 U.S.C. § 119 of Korean Patent Application 10-2018-0155897 filed on Dec. 6, 2018, in the Korean Intellectual Property Office, the contents of both of which are incorporated herein by reference.

TECHNICAL FIELD

The present disclosure relates to a high pressure scroll compressor.

BACKGROUND ART

Generally, a compressor is a machine that receives power from a power generating device, such as an electric motor or a turbine, to compress air, refrigerant or various other working gases to increase the pressure. It is widely used in household appliances, such as refrigerators and air conditioners, or throughout the industry.

The compressor is classified into a reciprocating compressor in which a compression chamber, in which a working gas is sucked and discharged, is formed between a piston and a cylinder and the piston reciprocates linearly in the cylinder to compress the refrigerant, a rotary compressor in which a compression chamber, in which a working gas is sucked and discharged, is formed between a rolling piston that rotates eccentrically and a cylinder, and the rolling piston eccentrically rotates along an inner wall of the cylinder to compress the refrigerant, and a scroll compressor in which a compression chamber, in which a working gas is sucked and discharged, is formed between an orbiting scroll and a fixed scroll, and the orbiting scroll rotates along the fixed scroll to compress the refrigerant.

A scroll compressor is a device for compressing a refrigerant by relative movements between fixed and orbiting scrolls each including a spiral wrap.

The scroll compressor compresses the refrigerant sucked into a compression chamber by gradually reducing the volume of the compression chamber as the orbiting scroll orbits, and discharges the compressed refrigerant through a discharge port in response to that a certain compression ratio is reached.

According to a refrigerant suction method, the scroll compressor may be classified into a low-pressure scroll compressor, which is an indirect suction method, and a high-pressure scroll compressor, which is a direct suction method.

In the high-pressure scroll compressor, the refrigerant sucked through a suction pipe flows into the compression chamber, and the refrigerant introduced into the compression chamber is compressed while being moved to the center of the compression chamber by the orbiting motion of the orbiting scroll.

After being compressed, the compressed refrigerant is discharged into a space inside a main body through the discharge port formed on a central shaft of the fixed scroll.

By the discharged high-pressure refrigerant, the space inside the main body becomes a high-pressure state, and most of the high-pressure refrigerant may flow out through a discharge pipe provided on one side of the main body, and some of the high-pressure refrigerant may be moved to a lower portion of the main body to compress oil.

In response to that the refrigerant is compressed in the compression chamber, an internal pressure of the compression chamber acts in a direction that the orbiting scroll moves away from the fixed scroll, and thus a back pressure chamber, in which an intermediate-pressure refrigerant is filled and a pressure acts in a direction in which the orbiting scroll faces the fixed scroll, may be provided under the compression chamber.

In response to that the high-pressure scroll compressor is operated under normal conditions, the pressure of the refrigerant discharged to the discharge port is greater than the pressure of the back pressure chamber, in which the intermediate pressure refrigerant is charged, but under partial load conditions, the pressure of the back pressure chamber may be greater than a discharge pressure of the refrigerant discharged through the discharge port.

In response to the pressure of the compression chamber being greater than the discharge pressure of the refrigerant, the refrigerant of the compression chamber may be bypassed to a space inside the main body through a bypass flow path.

However, in a case in which the refrigerant is not discharged smoothly through the bypass flow path, some of the refrigerant discharged to the discharge port may flow into the back pressure chamber through a back pressure hole, and thus mechanical loss may occur due to discharge loss and excessive back pressure.

DISCLOSURE

Technical Problem

The present disclosure is directed to providing a high-pressure scroll compressor, in response to a discharged refrigerant flowing into a back pressure chamber, capable of directly discharging the refrigerant to a space inside a main body, and capable of maintaining an intermediate pressure of the back pressure chamber to be less than a discharge pressure of the refrigerant by separately providing a discharge flow path in the back pressure chamber.

Technical Solution

One aspect of the present disclosure provides a high-pressure scroll compressor including a main body, a fixed scroll fixed inside the main body and including a discharge port through which a high-pressure refrigerant is discharged, an orbiting scroll engaged with the fixed scroll to perform a relative orbiting motion, and forming a compression chamber with the fixed scroll, a main frame fixed inside the main body so as to be located under the orbiting scroll and including a back pressure chamber filled with an intermediate-pressure refrigerant, a back pressure hole provided in the orbiting scroll and provided to allow the compression chamber to communicate with the back pressure chamber, a bypass portion provided in plural on an upper surface of the fixed scroll and configured to selectively bypass the refrigerant of the compression chamber to a space inside the main body, and a back pressure chamber discharge portion configured to selectively discharge the refrigerant of the back pressure chamber to the space inside the main body.

The back pressure chamber discharge portion may include a back pressure chamber discharge flow path provided in the fixed scroll to discharge the refrigerant inside the back pressure chamber into the space inside the main body, and a back pressure chamber discharge valve configured to selectively open and close the back pressure chamber discharge flow path.

The back pressure chamber discharge flow path may be provided to pass through the fixed scroll from an outer portion of the upper surface of the fixed scroll to the back pressure chamber.

The back pressure chamber discharge valve may be provided on the outer portion of the upper surface of the fixed scroll.

The back pressure chamber discharge portion may include a back pressure chamber discharge flow path provided in the main frame to discharge the refrigerant inside the back pressure chamber into the space inside the main body, and a back pressure chamber discharge valve configured to selectively open and close the back pressure chamber discharge flow path.

The back pressure chamber discharge flow path may be provided to pass through the main frame from an outer portion of a lower surface of the main frame to the back pressure chamber.

The back pressure chamber discharge valve may be provided on the outer portion of the lower surface of the main frame.

The back pressure hole may include a first back pressure hole provided to allow the compression chamber to communicate with the back pressure chamber, and a second back pressure hole provided to allow a back pressure groove, which is provided in the fixed scroll, to communicate with the first back pressure hole.

The back pressure chamber discharge portion may include a back pressure chamber discharge flow path provided in the fixed scroll to discharge the refrigerant inside the back pressure chamber into the space inside the main body, and a back pressure chamber discharge valve configured to selectively open and close the back pressure chamber discharge flow path.

The back pressure chamber discharge flow path may be provided to pass through the fixed scroll so as to communicate with the back pressure groove at the outer portion of the upper surface of the fixed scroll, and the second back pressure hole may periodically communicate with the back pressure groove according to the orbiting motion of the orbiting scroll.

The back pressure chamber discharge valve may be provided on the outer portion of the upper surface of the fixed scroll.

In response to an internal pressure of the back pressure chamber being greater than a pressure of the refrigerant discharged to the discharge port, the back pressure chamber may maintain the internal pressure of the back pressure chamber to be less than the pressure of the refrigerant discharged to the discharge port by discharging the refrigerant of the back pressure chamber to the space inside the main body.

By maintaining the internal pressure of the back pressure chamber to be less than the pressure of the refrigerant discharged to the discharge port, the back pressure chamber discharge portion may prevent a part of the refrigerant discharged from the discharge port from flowing into the back pressure chamber through the back pressure hole.

Advantageous Effects

In response to that a discharged refrigerant flows into a back pressure chamber under partial load conditions, it is possible to directly discharge the refrigerant to a space inside a main body, and to maintain an intermediate pressure of the back pressure chamber to be less than a discharge pressure of the refrigerant.

MODE FOR INVENTION

Figure 1:
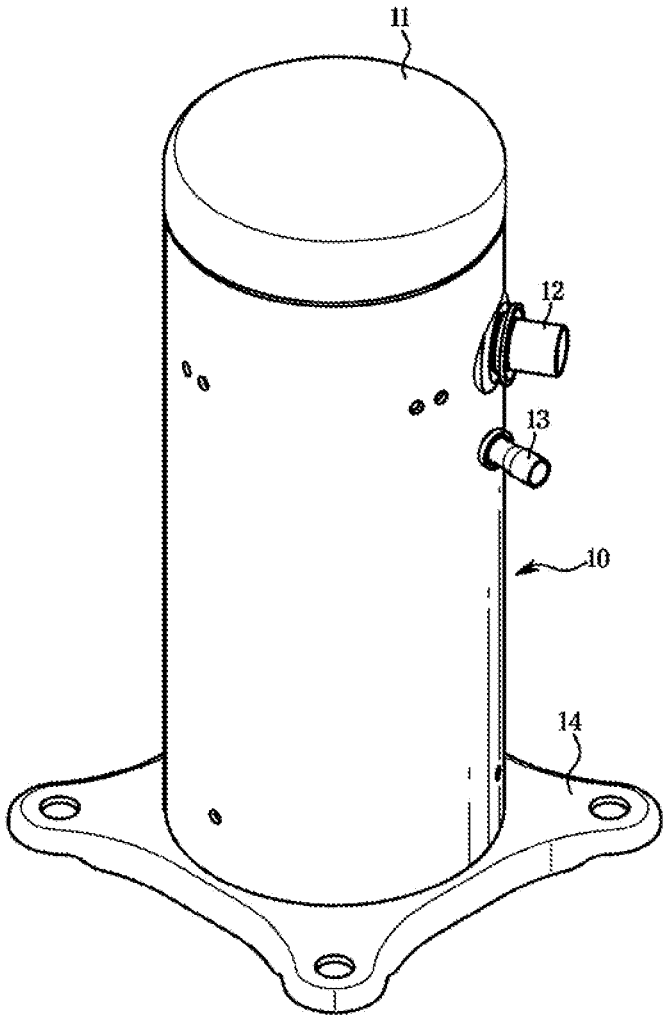
FIG. 1 is a perspective view of a high-pressure scroll compressor according to one embodiment of the present disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front end", "rear end", "upper portion", "lower portion", "upper end", "lower end" and the like may be defined by the drawings, but the shape and the location of the component is not limited by the term.

The disclosure will be described more fully hereinafter with reference to the accompanying drawings.

Figure 2:
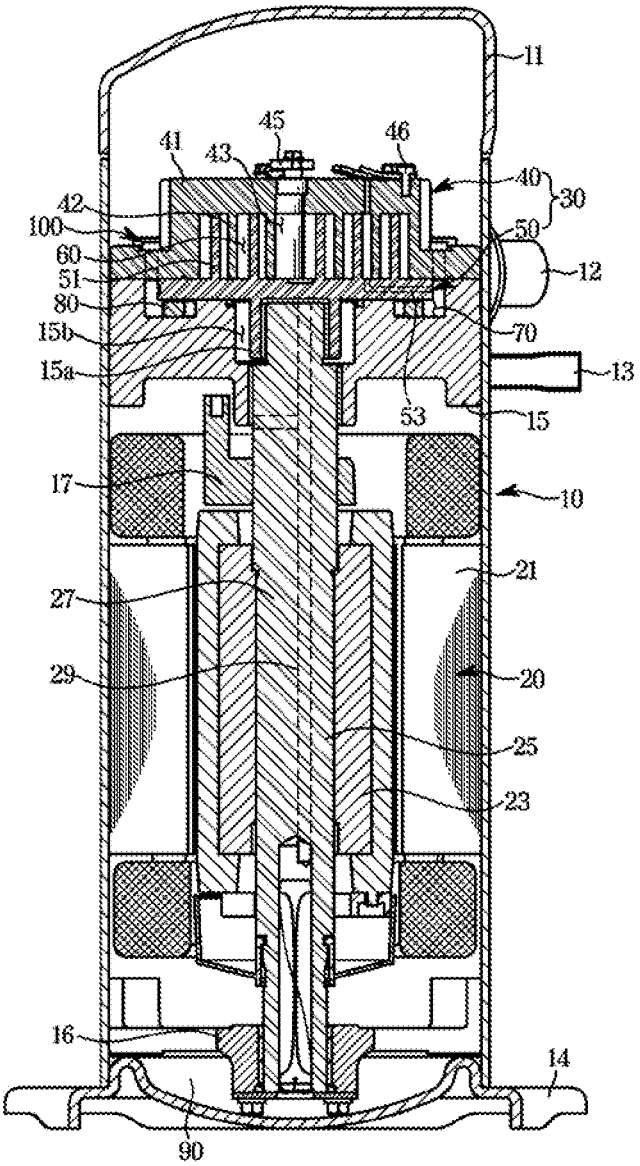
FIG. 2 is a side cross-sectional view of the high-pressure scroll compressor according to one embodiment of the present disclosure.

FIG. 1 is a perspective view of a high-pressure scroll compressor according to one embodiment of the present disclosure, and FIG. 2 is a side cross-sectional view of the high-pressure scroll compressor according to one embodiment of the present disclosure.

As illustrated in FIGS. 1 and 2, a high-pressure scroll compressor may include a main body 10 including a closed inner space, and a drive unit 20 and a compression unit 30 disposed in the main body 10.

The main body 10 may include an upper cap 11 mounted on an upper portion of the main body 10 to seal the main body 10, a suction pipe 12 provided to allow a refrigerant to flow into the main body 10, a discharge pipe 13 provided to discharge the refrigerant, which is suctioned through the suction pipe 12 and compressed, to the outside of the main body 10, and a bottom plate 14 provided on a bottom of the main body 10 to support the main body 10.

A main frame 15 and a sub frame 16 may be respectively fixed to an inner upper portion and an inner lower portion of the main body 10. The drive unit 20 may be disposed between the main frame 15 and the sub frame 16.

The drive unit 20 may be provided in the inner lower portion of the main body 10, and may include a stator 21 press-fitted in the lower portion of the main body 10, a rotor 23 rotatably installed at a center of the stator 21, and a rotation shaft 25 provided to transmit a rotational force of the rotor 23 to the compression unit 30.

A balance weight 17 may be mounted to each of upper and lower portions of the rotor 23 to adjust unbalanced rotation of the rotor 23 during rotation of the rotor 23.

The rotation shaft 25 may be disposed between the main frame 15 and the sub frame 16 to transmit a rotational force generated from the drive unit 20 to an orbiting scroll 50 of the compression unit 30.

An eccentric portion 27 eccentrically spaced from a center point of the rotation shaft 25 may be disposed at an upper end of the rotation shaft 25.

A through-hole 15*a* through which the rotation shaft 25 passes may be disposed at the center of the main frame 15. An oil storage portion 15*b* provided to accommodate oil suctioned through the rotation shaft 25 may be formed in the vicinity of the through-hole 15*a*.

An oil flow path 29 may be formed to pass through the rotation shaft 25 in an axial direction of the rotation shaft 25, and an oil pump (not shown) may be mounted to a lower end of the oil flow path 29.

An oil storage space 90 may be located at an inner bottom surface of the main body 10.

A lower end of the rotation shaft 25 may extend to oil stored in the oil storage space 90 to allow oil stored in the oil storage space 90 to be moved upward through the oil flow path 29 formed in the axial direction of the rotation shaft 25.

Oil stored in the oil storage space 90 may be pumped by an oil pump (not shown) mounted to the lower end of the rotation shaft 25 and the oil may be moved to the upper end of the rotation shaft 25 along the oil flow path 29 formed in the rotation shaft 25 and then arrive at the compression unit 30.

The compression unit 30 may be provided above the drive unit 20 in the main body 10, and may include a fixed scroll 40 fixedly installed in the main body 10, and an orbiting scroll 50 engaged with the fixed scroll 40 to perform a relative orbiting motion.

The fixed scroll 40 may be fixedly installed in the main body 10 so as to be positioned above the main frame 15. The fixed scroll 40 may include a body 41, a fixed wrap 42 provided to have a predetermined thickness and height in the body 41, a discharge port 43 formed to pass through a center of the body 41 to allow a high-pressure refrigerant, which is discharged from a compression chamber 60, to be discharged, an inlet port (not shown) formed at one side of the body 41, a discharge port opening/closing valve 45 configured to open and close the discharge port 43, and a plurality of bypass portions 46 provided on an upper surface of the body 41 and configured to selectively bypass the refrigerant of the compression chamber 60 to a space inside the main body 10.

As for the fixed scroll 40, the fixed wrap 43 may be engaged with an orbiting wrap 51 of the orbiting scroll 50 located under the fixed scroll 40 so as to form the compression chamber 60.

The orbiting scroll 50 may be positioned between the fixed scroll 40 and the upper flange 15 to perform an orbiting motion with respect to the fixed scroll 40.

The orbiting scroll 50 may be fitted in the rotation shaft 25, thereby being driven by the rotation shaft 25. The orbiting scroll 50 may include the orbiting wrap 51 formed to have a spiral-shape on an upper surface thereof, and a back pressure hole 53 provided to allow a back pressure chamber 70 to communicate with the compression chamber 60.

The compression chamber 60 may be formed by the fixed scroll 40 and the orbiting scroll 50. The compression chamber 60 may compress a refrigerant in such a way that the refrigerant suctioned into the compression chamber 60 is moved to the center of the compression chamber 60 by a continuous orbiting motion of the orbiting scroll 50, and the volume thereof is reduced.

The refrigerant suctioned into the main body 10 through the suction pipe 12 may flow into the compression chamber 60 through the inlet port of the fixed scroll 40. The refrigerant flowing into the compression chamber 60 may be compressed and then discharged to the outside of the fixed scroll 40 through the discharge port 43.

Figure 3:
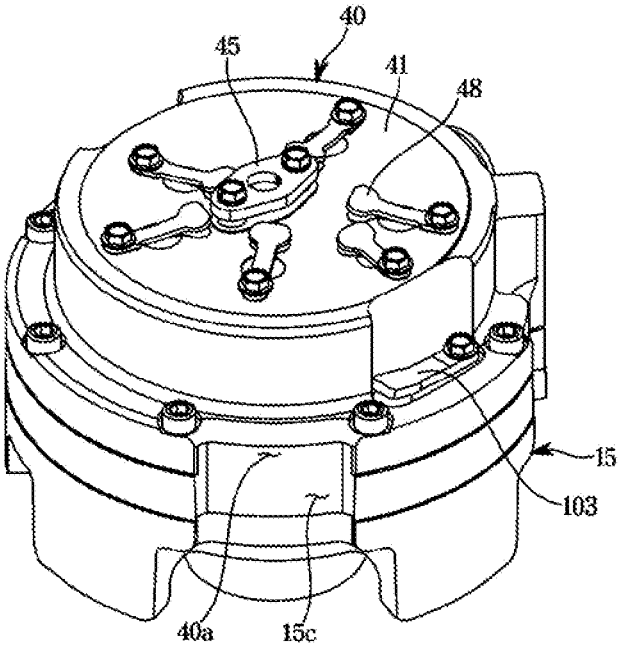
FIG. 3 is a perspective view illustrating a portion of the high-pressure scroll compressor according to one embodiment of the present disclosure, when viewed from the top.

Most of the high-pressure refrigerant discharged to the outside of the fixed scroll 40 may be discharged to the outside of the main body 10 through the discharge pipe 13, and a part of the high-pressure refrigerant may be moved to a lower side of the main body 10 through a first communication portion 40*a* provided on an outer circumferential surface of the fixed scroll 40 and a second communication portion 15*c* provided on an outer circumferential surface of the main frame 15 (refer to FIG. 3).

The refrigerant, which is introduced into and compressed by the compression chamber 60, may be changed into a high-pressure state and then discharged through the discharge port 43, and the refrigerant inside the compression chamber 60 may compress the orbiting scroll 50 in a direction in which the orbiting scroll 50 is away from the fixed scroll 40.

Because an internal pressure of the compression chamber 60 acts in the direction in which the orbiting scroll 50 is away from the fixed scroll 40, the back pressure chamber 70, provided to transmit the pressure to a direction in which the orbiting scroll 50 faces the fixed scroll 40, may be provided under the orbiting scroll 50.

For this, a refrigerant having an intermediate pressure may be filled in the back pressure chamber 70 through the back pressure hole 53, and the back pressure chamber 70 may be provided at an edge of an upper surface of the main frame 15 to have a predetermined internal volume with a lower surface of the orbiting scroll 50.

An Oldham ring 80 provided to allow the orbiting scroll 50 to orbit while preventing a self-rotation of the orbiting scroll 50 may be provided between the orbiting scroll 50 and the main frame 15.

In response to that the high-pressure scroll compressor is normally operated, the pressure of the refrigerant discharged through the discharge port 43 is greater than the pressure inside the back pressure chamber 70 filled with the intermediate-pressure refrigerant.

However, under partial load conditions, the internal pressure of the back pressure chamber 70 may be greater than the pressure of the refrigerant discharged through the discharge port 43.

In response to that the internal pressure of the back pressure chamber 70 is greater than the discharge pressure of the refrigerant discharged through the discharge port 43, a part of the refrigerant discharged through the discharge port 43 may flow into the back pressure chamber 70 through the back pressure hole 53.

To prevent this, the plurality of bypass portions 46 configured to selectively bypass the refrigerant of the compression chamber 60 to a space inside the main body 10 may be provided on the upper surface of the fixed scroll 40.

Figure 4:
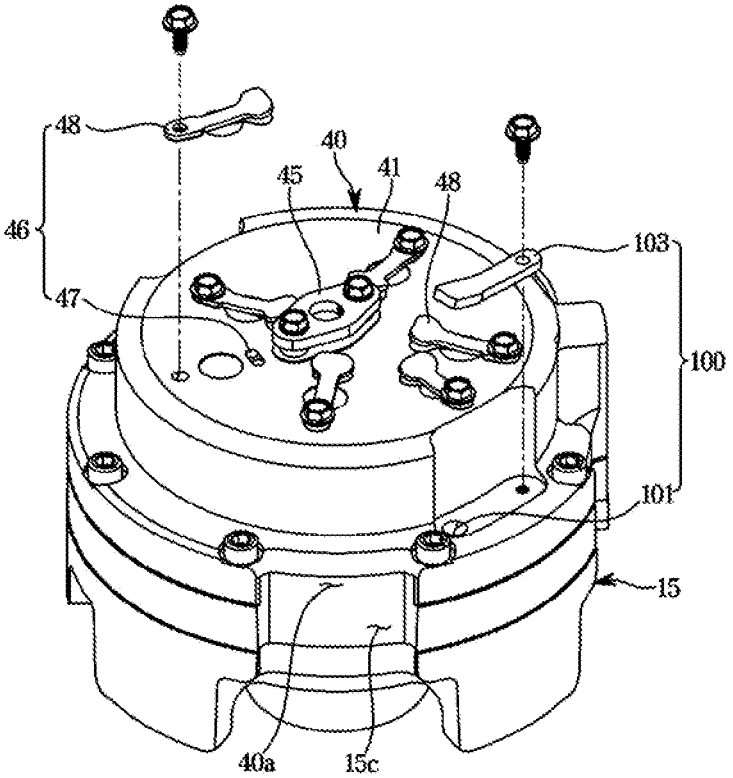
FIG. 4 is a view illustrating a state in which a bypass valve and a back pressure chamber discharge valve are separated, based on FIG. 3.
Figure 5:
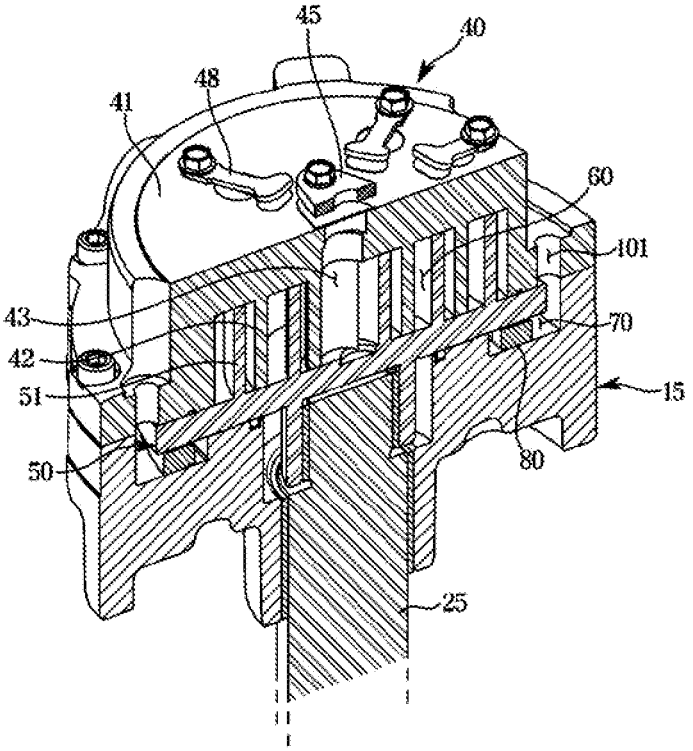
FIG. 5 is a view illustrating a state in which a portion of the high-pressure scroll compressor according to one embodiment of the present disclosure is cut.
Figure 6:
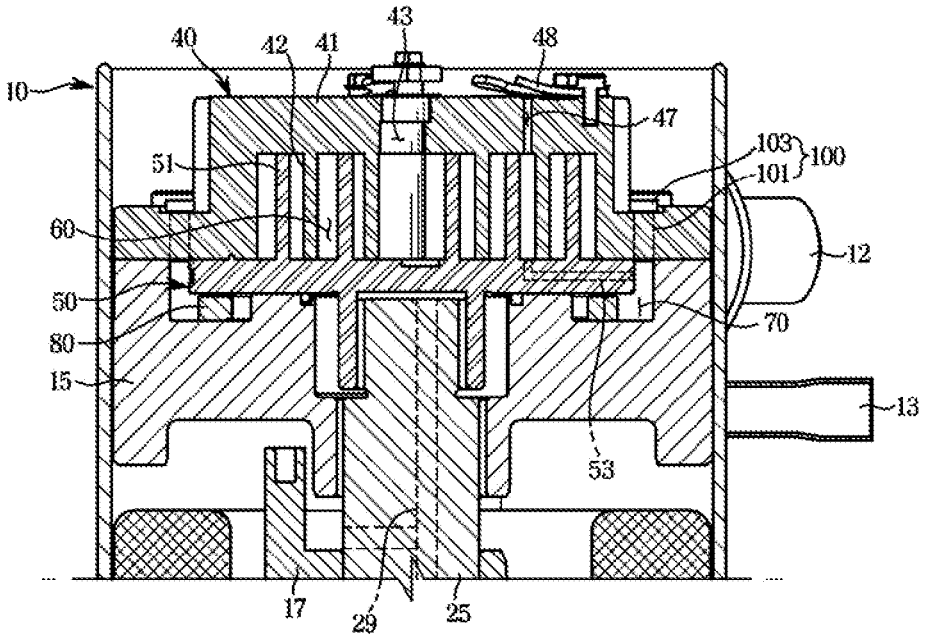
FIG. 6 is a cross-sectional view illustrating a portion of the high-pressure scroll compressor according to one embodiment of the present disclosure.

FIG. 3 is a perspective view a portion of the high-pressure scroll compressor according to one embodiment of the present disclosure, when viewed from the top, FIG. 4 is a view illustrating a state in which a bypass valve and a back pressure chamber discharge valve are separated, based on FIG. 3, FIG. 5 is a view illustrating a state in which a portion of the high-pressure scroll compressor according to one embodiment of the present disclosure is cut, and FIG. 6 is a cross-sectional view illustrating a portion of the high-pressure scroll compressor according to one embodiment of the present disclosure.

As illustrated in FIGS. 3 to 6, the plurality of bypass portions 46 configured to selectively bypass the refrigerant of the compression chamber 60 to the space inside the main body 10 may be provided on the upper surface of the body 41 of the fixed scroll 40.

The bypass portion 46 may include a bypass hole 47 provided in plural on the upper surface of the body 41 of the fixed scroll 40 and a bypass valve 48 configured to selectively open and close the bypass hole 47.

In response to that the high-pressure scroll compressor is operated normally, the bypass valve 48 may close the bypass hole 47 to allow the refrigerant compressed in the compression chamber 60 to be discharged only through the discharge port 43.

In response to that the internal pressure of the compression chamber 60 is greater than the discharge pressure of the refrigerant discharged to the discharge port 43 due to an overload of the high-pressure chamber scroll compressor under partial load conditions, the bypass valve 48 may open the bypass hole 47.

In response to that the bypass valve 48 opens the bypass hole 47, even when a part of the high-pressure refrigerant discharged through the discharge port 43 flows into the compression chamber 60, the refrigerant may be discharged into the space inside the main body 10 through the bypass hole 47.

Accordingly, it is possible to prevent the refrigerant of the compression chamber 60 from flowing into the back pressure chamber 70 through the back pressure hole 53.

However, in response to that the refrigerant inside the compression chamber 60 is not smoothly discharged through the bypass portion 47, a part of the discharged refrigerant flowing into the compression chamber 60 may flow into the back pressure chamber 70 through the back pressure hole 53.

In response to that a part of the discharged refrigerant flows into the back pressure chamber 70 through the back pressure hole 53, a discharge loss may occur.

In addition, the internal pressure of the back pressure chamber 70 may be increased, and thus mechanical loss may additionally occur due to excessive back pressure.

To prevent this, the high pressure scroll compressor may include a back pressure chamber discharge portion 100 configured to selectively discharge the refrigerant inside the back pressure chamber 70 to the space inside the main body 10.

The back pressure chamber discharge portion 100 may be provided in plural.

The back pressure chamber discharge portion 100 may include a back pressure chamber discharge flow path 101 provided in the fixed scroll 40 to discharge the refrigerant inside the back pressure chamber 70 into the space inside the main body 10, and a back pressure chamber discharge valve 103 configured to selectively open and close the back pressure chamber discharge flow path 101.

The back pressure chamber discharge flow path 101 may be provided to pass through the fixed scroll 40 from an outer portion of the upper surface of the fixed scroll 40 to the back pressure chamber 70.

The back pressure chamber discharge valve 103 may be provided in the outer portion of the upper surface of the fixed scroll 40.

In response to that the high pressure scroll compressor is operated normally, the back pressure chamber discharge valve 103 may close the back pressure chamber discharge flow path 101.

In response to that the internal pressure of the back pressure chamber 70 is greater than the pressure of the refrigerant discharged to the discharge port 43 under partial load conditions, the back pressure chamber discharge valve 103 may open the back pressure chamber discharge flow path 101.

In response to the back pressure chamber discharge flow path 101 being opened, the refrigerant inside the back pressure chamber 70 may be directly discharged into a space above the fixed scroll 40, which is a space inside the main body 10.

In response to that the refrigerant inside the back pressure chamber 70 is discharged through the back pressure chamber discharge flow path 101, the internal pressure of the back pressure chamber 70 may be reduced so as to prevent that the refrigerant of the compression chamber 60 flows into the back pressure chamber 70 through the back pressure hole 53. Therefore, it is possible to maintain the internal pressure of the back pressure chamber 70 to be less than the discharge pressure.

In addition, even when a part of the discharged refrigerant flows into the back pressure chamber 70 through the back pressure hole 53, it is possible to directly discharge the refrigerant to the space above the fixed scroll 40, which is the space inside the main body 10.

Figure 7:
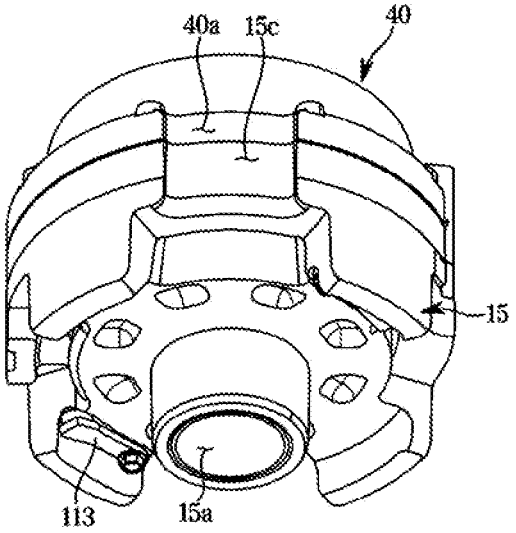
FIG. 7 is a perspective view illustrating a portion of a high-pressure scroll compressor according to another embodiment of the present disclosure, when viewed from the bottom.
Figure 8:
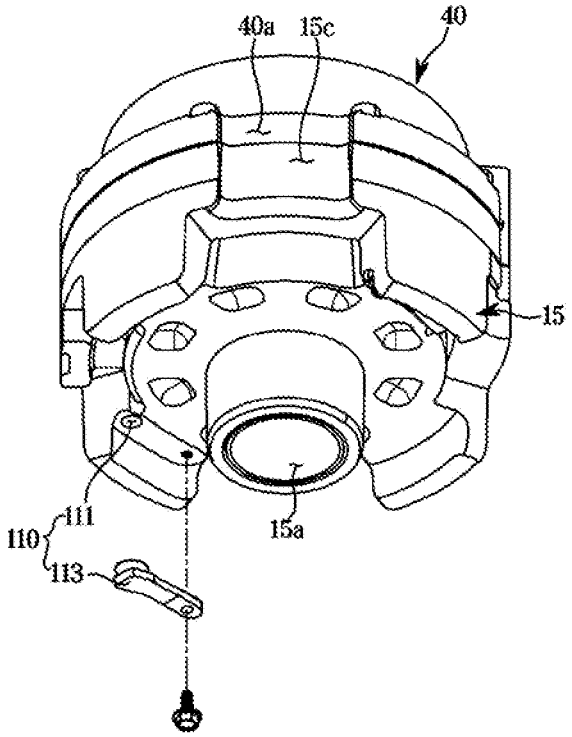
FIG. 8 is a view illustrating a state in which a bypass valve and a back pressure chamber discharge valve are separated, based on FIG. 7.
Figure 9:
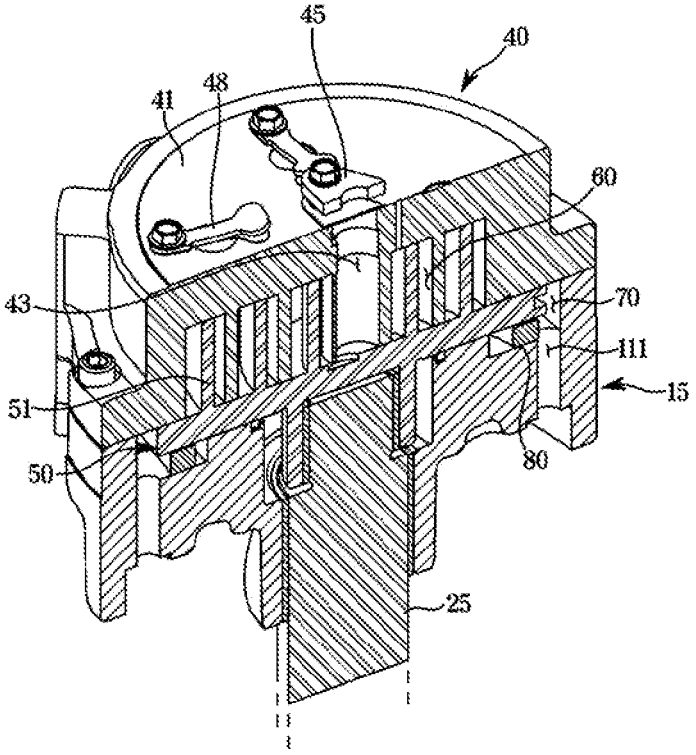
FIG. 9 is a view illustrating a state in which a portion of the high-pressure scroll compressor according to another embodiment of the present disclosure is cut.
Figure 10:
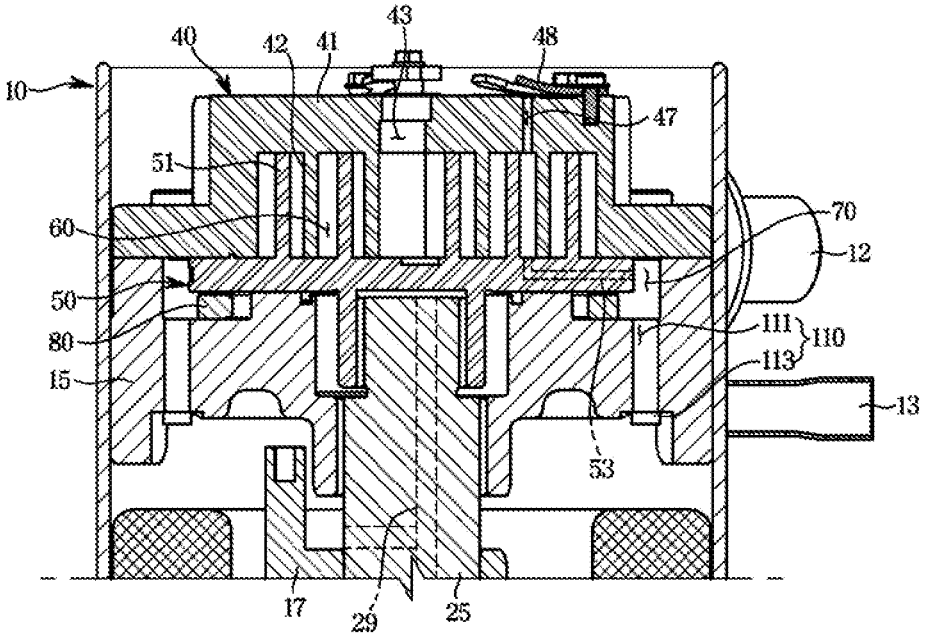
FIG. 10 is a cross-sectional view illustrating a portion of the high-pressure scroll compressor according to another embodiment of the present disclosure.

FIG. 7 is a perspective view illustrating a portion of a high-pressure scroll compressor according to another embodiment of the present disclosure, when viewed from the bottom, FIG. 8 is a view illustrating a state in which a bypass valve and a back pressure chamber discharge valve are separated, based on FIG. 7, FIG. 9 is a view illustrating a state in which a portion of the high-pressure scroll compressor according to another embodiment of the present disclosure is cut, and FIG. 10 is a cross-sectional view illustrating a portion of the high-pressure scroll compressor according to another embodiment of the present disclosure.

As illustrated in FIGS. 7 to 10, a bypass portion 46 may be provided on an upper surface of a body 41 of a fixed scroll 40, which is the same as the bypass portion 46 shown in FIGS. 3 to 6 and thus a description thereof will be omitted.

The high-pressure scroll compressor may include a back pressure chamber discharge portion 110 configured to selectively discharge the refrigerant in the back pressure chamber 70 to a space inside the main body 10.

The back pressure chamber discharge portion 110 may be provided in plural.

The back pressure chamber discharge portion 110 may include a back pressure chamber discharge flow path 111 provided in the main frame 15 to discharge the refrigerant inside the back pressure chamber 70 into a space inside the main body 10, and a back pressure chamber discharge flow path 111 configured to selectively open and close the back pressure chamber discharge flow path 111.

The back pressure chamber discharge flow path 111 may be provided to pass through the main frame 15 from the outer portion of the lower surface of the main frame 15 to the back pressure chamber 70.

The back pressure chamber discharge valve 113 may be provided on the outer portion of the lower surface of the main frame 15.

In response to that the high-pressure scroll compressor is normally operated, the back pressure chamber discharge valve 113 may close the back pressure chamber discharge flow path 111.

In response to that the internal pressure of the back pressure chamber 70 is greater than the pressure of the refrigerant discharged through the discharge port 43 under partial load conditions, the back pressure chamber discharge valve 113 may open the back pressure chamber discharge flow path 111.

In response to the back pressure chamber discharge flow path 111 being opened, the refrigerant inside the back pressure chamber 70 may be directly discharged into a space under the main frame 15, which is a space inside the main body 10.

In response to that the refrigerant inside the back pressure chamber 70 is discharged through the back pressure chamber discharge flow path 111, the internal pressure of the back pressure chamber 70 may be reduced so as to prevent that the refrigerant of the compression chamber 60 flows into the back pressure chamber 70 through the back pressure hole 53. Therefore, it is possible to maintain the internal pressure of the back pressure chamber 70 to be less than the discharge pressure.

In addition, even when a part of the discharged refrigerant flows into the back pressure chamber 70 through the back pressure hole 53, it is possible to directly discharge the refrigerant to the space under the main frame 15, which is a space inside the main body 10.

Figure 11:
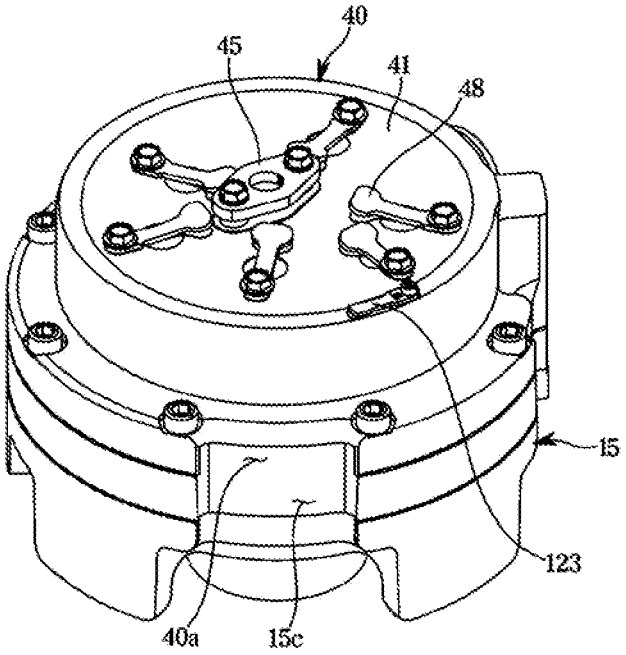
FIG. 11 is a perspective view illustrating a portion of a high pressure scroll compressor according to still another embodiment of the present disclosure, when viewed from the top.
Figure 12:
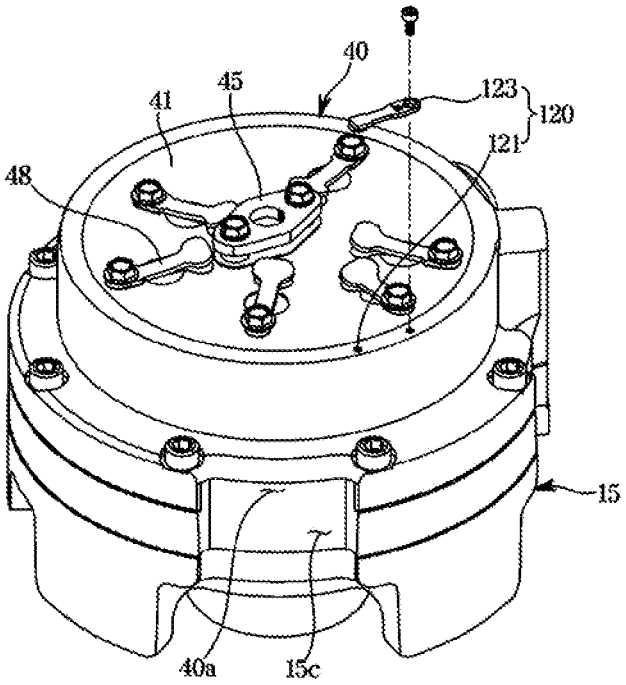
FIG. 12 is a view illustrating a state in which a bypass valve and a back pressure chamber discharge valve are separated, based on FIG. 11.
Figure 13:
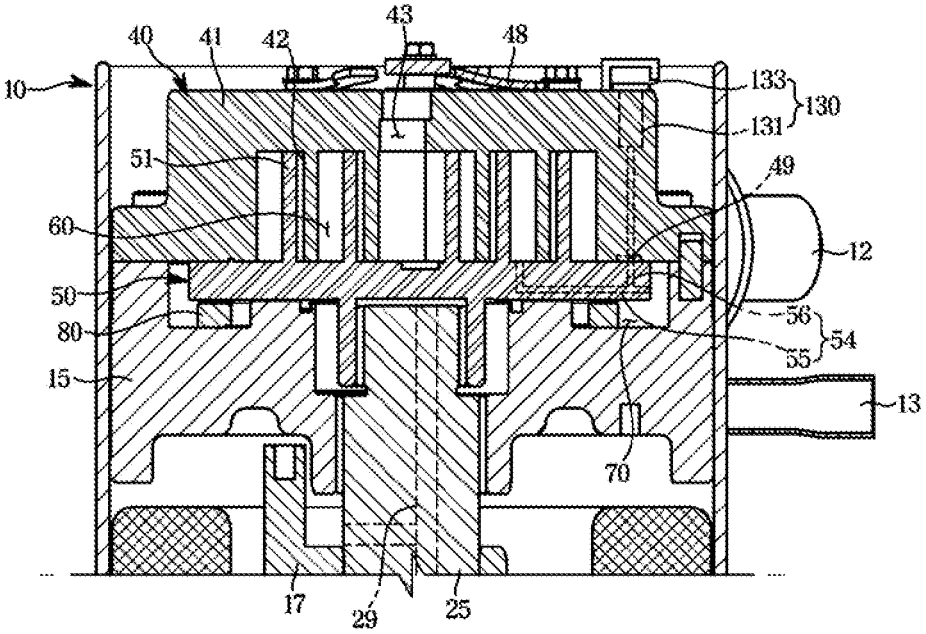
FIG. 13 is a cross-sectional view illustrating a portion of the high-pressure scroll compressor according to still another embodiment of the present disclosure.

FIG. 11 is a perspective view illustrating a portion of a high-pressure scroll compressor according to still another embodiment of the present disclosure, when viewed from the top, FIG. 12 is a view illustrating a state in which a bypass valve and a back pressure chamber discharge valve are separated, based on FIG. 11, and FIG. 13 is a cross-sectional view illustrating a portion of the high-pressure scroll compressor according to still another embodiment of the present disclosure.

As illustrated in FIGS. 11 to 13, a bypass portion 46 may be provided on an upper surface of a body 41 of a fixed scroll 40, which is the same as the bypass portion 46 shown in FIGS. 3 to 6 and thus, a description thereof will be omitted.

A back pressure hole 54, provided to allow the compression chamber 60 to communicate with the back pressure chamber 70 may include a first back pressure hole 55 provided in the orbiting scroll 50 to allow the compression chamber 60 to communicate with the back pressure chamber 70, and a second back pressure hole 56 to allow a back pressure groove 49 provided in the fixed scroll 40 to communicate with the first back pressure hole 55.

The back pressure groove 49 provided in the fixed scroll 40 and the second back pressure hole 56 provided in the orbiting scroll 50 may periodically communicate with each other according to the orbiting motion of the orbiting scroll 50.

The high-pressure scroll compressor may include a back pressure chamber discharge portion 120 configured to selectively discharge the refrigerant inside the back pressure chamber 70 to the space inside the main body 10.

The back pressure chamber discharge portion 120 may include a back pressure chamber discharge flow path 121 provided in the fixed scroll 40 to discharge the refrigerant inside the back pressure chamber 70 into a space inside the main body 10, and a back pressure chamber discharge valve 123 configured to selectively open and close the back pressure chamber discharge flow path 121.

The back pressure chamber discharge flow path 121 may be provided to pass through the fixed scroll 40 to communicate with the back pressure groove 49 at an outer portion of the upper surface of the fixed scroll 40.

The back pressure chamber discharge valve 123 may be provided in the outer portion of the upper surface of the fixed scroll 40.

In response to that the high-pressure scroll compressor is operated normally, the back pressure chamber discharge valve 123 may close the back pressure chamber discharge flow path 121.

In response to the back pressure chamber discharge flow path 121 is closed by the back pressure chamber discharge valve 123, the compression chamber 60 and the back pressure chamber 70 may communicate with each other by the first back pressure hole 55.

In response to that the internal pressure of the back pressure chamber 70 is greater than the pressure of the refrigerant discharged to the discharge port 43 under partial load conditions, the back pressure chamber discharge valve 123 may open the back pressure chamber discharge flow path 121.

In response to the back pressure chamber discharge flow path 121 being opened, the refrigerant inside the back pressure chamber 70 may be moved to the back pressure groove 49 through the first back pressure hole 55 and the second back pressure hole 56, and the refrigerant, which is moved to the back pressure groove 49, may be discharged to the space above the fixed scroll 40, which is a space inside the main body 10, through the back pressure chamber discharge flow path 121.

In response to that the refrigerant inside the back pressure chamber 70 is discharged through the back pressure chamber discharge flow path 121, the internal pressure of the back pressure chamber 70 may be reduced so as to prevent that the refrigerant of the compression chamber 60 flows into the back pressure chamber 70 through the first back pressure hole 55. Therefore, it is possible to maintain the internal pressure of the back pressure chamber 70 to be less than the discharge pressure.

In addition, even when a part of the discharged refrigerant flows into the back pressure chamber 70 through the first back pressure hole 55, the refrigerant may be moved to the back pressure groove 49 through the second back pressure hole 56 in a process of flowing into the back pressure chamber 70, and the refrigerant, which is moved to the back pressure groove 49, may be discharged to the space above the fixed scroll 40, which is the space inside the main body 10, through the back pressure chamber discharge flow path 121.

Figure 14:
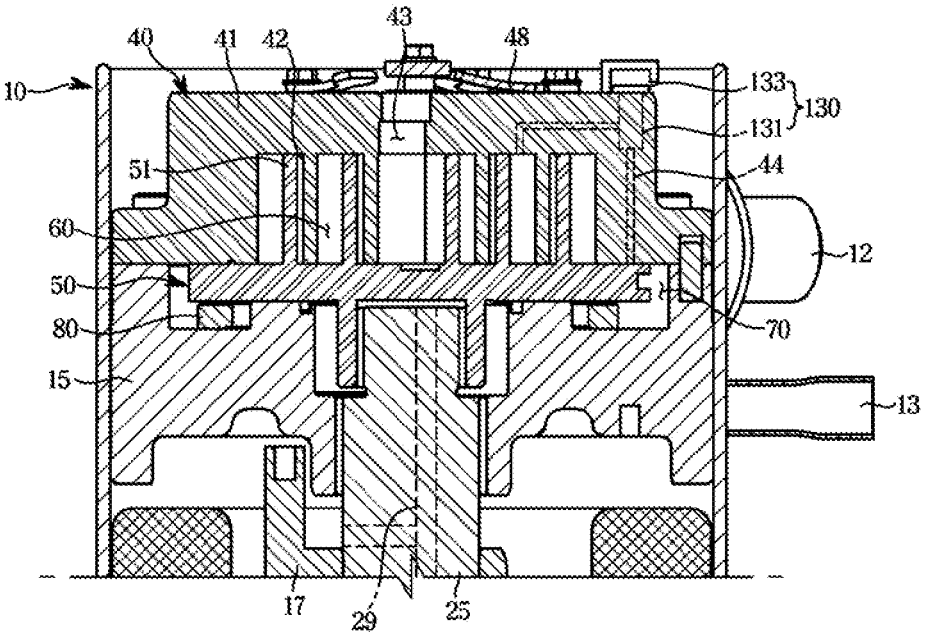
FIG. 14 is a cross-sectional view illustrating a portion of a high-pressure scroll compressor according to still another embodiment of the present disclosure.

FIG. 14 is a cross-sectional view illustrating a portion of a high-pressure scroll compressor according to still another embodiment of the present disclosure.

As illustrated in FIG. 14, a bypass portion 46 may be provided on an upper surface of a body 41 of a fixed scroll 40, which is the same as the bypass portion 46 shown in FIGS. 3 to 6 and thus, a description thereof will be omitted.

Because configurations other than configurations of a back pressure hole 44 and a back pressure chamber discharge portion 130 are the same as those of the high-pressure scroll compressors illustrated in FIGS. 1 to 6, a description of the same configuration will be omitted.

The back pressure hole 44 provided to allow the compression chamber 60 to communicate with the back pressure chamber 70 may be provided in the fixed scroll 40.

The high-pressure scroll compressor may include the back pressure chamber discharge portion 130 configured to selectively discharge the refrigerant inside the back pressure chamber 70 to the space inside the main body 10.

The back pressure chamber discharge portion 130 may include a back pressure chamber discharge flow path 131 provided in the fixed scroll 40 to discharge the refrigerant inside the back pressure chamber 70 into a space inside the main body 10, and a back pressure chamber discharge valve 133 configured to selectively open and close the back pressure chamber discharge flow path 131.

The back pressure chamber discharge flow path 131 may be provided to pass through the fixed scroll 40 to communicate with the back pressure hole 44 at an outer portion of the upper surface of the fixed scroll 40.

The back pressure chamber discharge valve 133 may be provided in the outer portion of the upper surface of the fixed scroll 40.

In response to that the high-pressure scroll compressor is operated normally, the back pressure chamber discharge valve 133 may close the back pressure chamber discharge flow path 131.

In response to the back pressure chamber discharge flow path 131 is closed by the back pressure chamber discharge valve 133, the compression chamber 60 and the back pressure chamber 70 may communicate with each other by the back pressure hole 44.

In response to that the internal pressure of the back pressure chamber 70 is greater than the pressure of the refrigerant discharged to the discharge port 43 under partial load conditions, the back pressure chamber discharge valve 133 may open the back pressure chamber discharge flow path 131.

In response to the back pressure chamber discharge flow path 101 being opened, the refrigerant inside the back pressure chamber 70 may be moved to the back pressure chamber discharge flow path 131 through the back pressure hole 44, and then discharged to the space above the fixed scroll 40, which is a space inside the main body 10.

In response to that the refrigerant inside the back pressure chamber 70 is discharged through the back pressure chamber discharge flow path 131, the internal pressure of the back pressure chamber 70 may be reduced so as to prevent that the refrigerant of the compression chamber 60 flows into the back pressure chamber 70 through the back pressure hole 44. Therefore, it is possible to maintain the internal pressure of the back pressure chamber 70 to be less than the discharge pressure.

In addition, even when a part of the discharged refrigerant flows into the back pressure chamber 70 through the back pressure hole 44, the refrigerant may be discharged to the space above the fixed scroll 40, which is a space inside the main body 10, through the back pressure hole 44 and the back pressure chamber discharge flow path 131.

While the present disclosure has been particularly described with reference to exemplary embodiments, it should be understood by those of skilled in the art that various changes in form and details may be made without departing from the spirit and scope of the present disclosure.

The invention claimed is:

1. A high-pressure scroll compressor comprising:

a main body;

a fixed scroll fixed inside the main body and comprising a fixed body, a fixed wrap provided in the fixed body and a discharge port through which a high-pressure refrigerant is discharged;

an orbiting scroll engaged with the fixed scroll to perform a relative orbiting motion, and comprising an orbiting body and an orbiting wrap provided to be engaged with the fixed wrap to form a compression chamber;

a main frame fixed inside the main body so as to be located under the orbiting scroll and comprising a back pressure chamber filled with an intermediate-pressure refrigerant;

a bypass portion provided in plural on an upper surface of the fixed body of the fixed scroll and configured to selectively bypass a refrigerant of the compression chamber to a space inside the main body;

a back pressure chamber discharge portion configured to selectively discharge the refrigerant of the back pressure chamber to the space inside the main body and disposed radially spaced apart from the bypass portion, the back pressure chamber discharge portion comprising a back pressure chamber discharge valve provided on the upper surface of the fixed body of the fixed scroll, a back pressure groove recessed in a lower surface of the fixed body of the fixed scroll in contact with an upper surface of the orbiting body of the orbiting scroll, and a back pressure chamber discharge flow path provided to pass through the fixed body of the fixed scroll and to allow the back pressure groove to communicate with the back pressure chamber discharge valve; and a back pressure hole provided in the orbiting body of the orbiting scroll, wherein the back pressure hole comprises a first back pressure hole provided to allow the compression chamber to communicate with the back pressure chamber, and a second back pressure hole provided to branch from the first back pressure hole and extending to the upper surface of the orbiting body of the orbiting scroll to allow the first back pressure hole to communicate with the back pressure groove.

2. The high-pressure scroll compressor of claim 1, wherein the back pressure chamber discharge valve is configured to selectively open and close the back pressure chamber discharge flow path.

3. The high-pressure scroll compressor of claim 2, wherein the back pressure chamber discharge flow path is provided to pass through the fixed scroll from an outer portion of the upper surface of the fixed body of the fixed scroll to the back pressure chamber.

4. The high-pressure scroll compressor of claim 3, wherein the back pressure chamber discharge valve is provided on the outer portion of the upper surface of the fixed body of the fixed scroll.

5. The high-pressure scroll compressor of claim 1, wherein the second back pressure hole periodically communicates with the back pressure groove according to the orbiting motion of the orbiting scroll.

6. The high-pressure scroll compressor of claim 1, wherein the back pressure chamber discharge valve is provided on an outer portion of the upper surface of the fixed body of the fixed scroll.

7. The high-pressure scroll compressor of claim 1, wherein in response to an internal pressure of the back pressure chamber being greater than a pressure of the refrigerant discharged to the discharge port, the back pressure chamber maintains the internal pressure of the back pressure chamber to be less than the pressure of the refrigerant discharged to the discharge port by discharging the refrigerant of the back pressure chamber to the space inside the main body.

8. The high-pressure scroll compressor of claim 7, wherein by maintaining the internal pressure of the back pressure chamber to be less than the pressure of the refrigerant discharged to the discharge port, the back pressure chamber discharge portion prevents a part of the refrigerant discharged from the discharge port from flowing into the back pressure chamber through the back pressure hole.

* * * * *